US008784083B2

(12) United States Patent
Dippel

(10) Patent No.: US 8,784,083 B2
(45) Date of Patent: Jul. 22, 2014

(54) PUMP HAVING A FLOW GUIDE DEVICE BETWEEN AT LEAST ONE PRESSURE PLATE AND A HOUSING

(75) Inventor: Thomas Dippel, Neustadt (DE)

(73) Assignee: Magna Powertrain Bad Homburg GmbH, Bad Homburg v.d.H. (DE)

( * ) Notice: Subject to any disclaimer, the term of this patent is extended or adjusted under 35 U.S.C. 154(b) by 368 days.

(21) Appl. No.: 13/125,268

(22) PCT Filed: Sep. 16, 2009

(86) PCT No.: PCT/DE2009/001298

§ 371 (c)(1),
(2), (4) Date: Apr. 20, 2011

(87) PCT Pub. No.: WO2010/045906

PCT Pub. Date: Apr. 29, 2010

(65) Prior Publication Data

US 2011/0211985 A1 Sep. 1, 2011

(30) Foreign Application Priority Data

Oct. 22, 2008 (DE) ..... 10 2008 052 778

(51) Int. Cl.
*F04C 2/00* (2006.01)
*F04C 15/00* (2006.01)
*F04C 29/00* (2006.01)

(52) U.S. Cl.
USPC ..... 418/82; 418/135; 418/256; 418/268

(58) Field of Classification Search
USPC ..... 418/82, 133–135, 256, 266–268
See application file for complete search history.

(56) References Cited

U.S. PATENT DOCUMENTS

| | | | | |
|---|---|---|---|---|
| 3,223,044 | A | 12/1965 | Adams et al. | |
| 4,431,389 | A | 2/1984 | Johnson | |
| 5,807,090 | A * | 9/1998 | Agner | 418/135 |
| 6,481,990 | B2 * | 11/2002 | Wong et al. | 418/82 |
| 6,655,936 | B2 * | 12/2003 | Szeszulski et al. | 418/82 |

FOREIGN PATENT DOCUMENTS

| | | |
|---|---|---|
| DE | 1528934 | 4/1970 |
| DE | 19631846 | 2/1997 |
| EP | 0068354 | 1/1983 |
| EP | 1767784 | 3/2007 |
| JP | 61079881 | 4/1986 |

* cited by examiner

*Primary Examiner* — Theresa Trieu
(74) *Attorney, Agent, or Firm* — Davidson, Davidson & Kappel, LLC

(57) ABSTRACT

A pump, particularly a vane-type pump, including a rotor guiding at least one vane and resting against at least one pressure plate, which has at least one pressure through-hole and at least one under-vane through-hole, the holes being connected to a pressure outlet provided in a housing of the pump or in a transmission housing. In between the pressure plate and the housing a flow guide device is arranged, which delimits a fluid path from the pressure through-hole past the under-vane through-hole to the pressure outlet.

18 Claims, 2 Drawing Sheets

PUMP HAVING A FLOW GUIDE DEVICE BETWEEN AT LEAST ONE PRESSURE PLATE AND A HOUSING

The present invention relates to a pump, in particular a vane-type pump, including a rotor carrying at least one vane and resting against at least one pressure plate, said pressure plate having at least one pressure passage hole and at least one under-vane passage hole, said passage holes being in communication with a pressure outlet provided in a housing of the pump or in a transmission housing.

BACKGROUND

German Laid-Open Application DE 196 31 846 A1 describes a vane-type pump having a first fluid path leading from a pressure side to a consumer, and further having at least one hydraulic resistance element, which is disposed in a second fluid path connecting the pressure areas. The hydraulic resistance element is in the form of a cold-start plate by which the pressure areas of the pump sections can be separated.

SUMMARY OF THE INVENTION

An object of the present invention is to provide a pump, in particular a vane-type pump, including a rotor carrying at least one vane and resting against at least one pressure plate, said pressure plate having at least one pressure passage hole and at least one under-vane passage hole, said passage holes being in communication with a pressure outlet provided in a housing of the pump, that will have high efficiency and/or improved cold-start performance.

In a pump, in particular a vane-type pump, including a rotor carrying at least one vane and resting against at least one pressure plate, said pressure plate having at least one pressure passage hole and at least one under-vane passage hole, said passage holes being in communication with a pressure outlet provided in a housing of the pump, the aforementioned object is achieved by a flow guide device disposed between the pressure plate and the housing, said flow guide device bounding a fluid path from the pressure passage hole past the under-vane passage hole to the pressure outlet. The pressure passage hole is preferably in the form of a kidney-shaped pressure port and is in communication with a pressure chamber inside the pump. The under-vane passage hole is preferably in the form of a kidney-shaped under-vane port and serves to ensure fluid supply to the area under the vane or vanes of the pump. The flow guide device of the present invention causes a working medium, in particular a hydraulic medium, such as oil, to be directed along a desired path from the pressure passage hole first to the under-vane passage hole, and only subsequently to the pressure outlet of the pump. This allows the cold-start performance of the pump to be improved without the disadvantages of a cold-start plate, the use of which would result in an additional pressure differential, and thus increased power consumption.

In a preferred exemplary embodiment of the pump, the pressure plate includes a first plane containing the pressure passage hole and the under-vane passage hole, and a second plane containing at least one flow channel which partially bounds the fluid path from the pressure passage hole past the under-vane passage hole to the pressure outlet. The first plane of the pressure plate preferably contains two pressure passage holes and two under-vane passage holes, which are interconnected by two flow channels in the second plane.

In another preferred exemplary embodiment of the pump, the flow channel in the second plane of the pressure plate is bounded by the flow guide device in an axial direction toward the housing. The term "axial" refers to the axis of rotation of the rotor, and means in the direction of or parallel to the axis of rotation of the rotor. The flow channel is bounded in the axial direction by the pressure plate and the flow guide device. Preferably, the flow channel is radially bounded by the pressure plate.

In a further exemplary embodiment of the pump, the pressure plate includes lands which extend in the second plane and separate two flow channels. The lands preferably extend radially. Preferably, the flow channels each bound one fluid path from a pressure passage hole past an under-vane passage hole to the pressure outlet.

In another preferred exemplary embodiment of the pump, the pressure plate includes a radially inner ring member which extends in the second plane and is engaged by a portion of the flow guide device. The inner ring member is preferably arranged coaxially with respect to the axis of rotation of the rotor.

In a further preferred exemplary embodiment of the pump, the pressure plate includes a further radially inner ring member which extends in the third plane and encircles the flow guide device and which is engaged by a seal. Preferably, the two inner ring members are integrally connected to each other via a shoulder and are coaxial with one another.

In yet another preferred exemplary embodiment of the pump, the pressure plate includes a radially outer ring member which extends in the second plane and is engaged by a portion of the flow guide device. The outer ring member is preferably arranged coaxially with respect to the axis of rotation of the rotor. Preferably, the outer ring member is integrally connected to the inner ring member by the lands.

In another preferred exemplary embodiment of the pump, the pressure plate includes a further radially outer ring member which extends in a third plane and encircles the flow guide device and which preferably serves only for centering purposes. Preferably, the two outer ring members are integrally connected to each other via a shoulder and are coaxial with one another.

In a further preferred exemplary embodiment of the pump, the housing is formed with a contact portion which engages or is engaged by the flow guide device. The contact portion preferably takes the form of an annular bulge, but may alternatively include a plurality of projections, which are preferably uniformly distributed in a circumferential direction.

In another preferred exemplary embodiment of the pump, the flow guide device takes the form of a diaphragm spring which is clamped between the pressure plate and the housing. Preferably, the diaphragm spring is clamped in such a way that the pressure plate is pressed against a contour ring. The contact pressure can be adjusted via the magnitude of the preload force.

In further preferred exemplary embodiments of the pump, the diaphragm spring is slotted at its radially outer periphery and/or is flattened at its radially outer periphery and/or has at least one passage hole. The slots and/or flattened portions and/or passage holes are preferably arranged in the region of the pressure outlet so as to ensure passage of the pressurized working medium therethrough.

In another preferred exemplary embodiment of the pump, the flow channel has a constriction in the region of an under-vane groove or kidney-shaped under-vane port. This enhances the flow towards the under-vane groove or kidney-shaped under-vane port.

BRIEF DESCRIPTION OF THE DRAWINGS

Further advantages and features of the present invention and details pertaining thereto are derived from the following description in which various exemplary embodiments are explained in detail with reference to the drawing. In the drawing.

DETAILED DESCRIPTION

Figure 1:
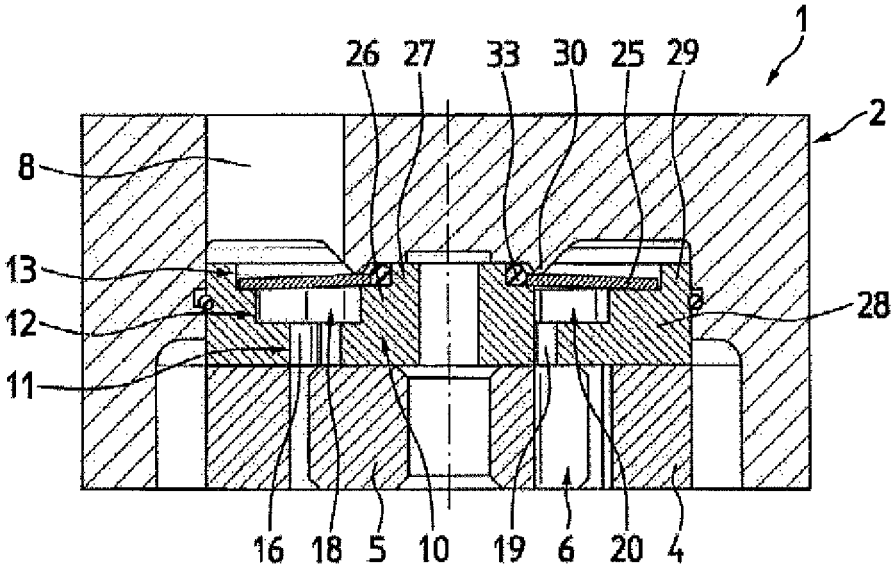
FIG. 1 is a cross-sectional view of a vane-type pump, taken along line I-I of FIG. 2.
Figure 2:
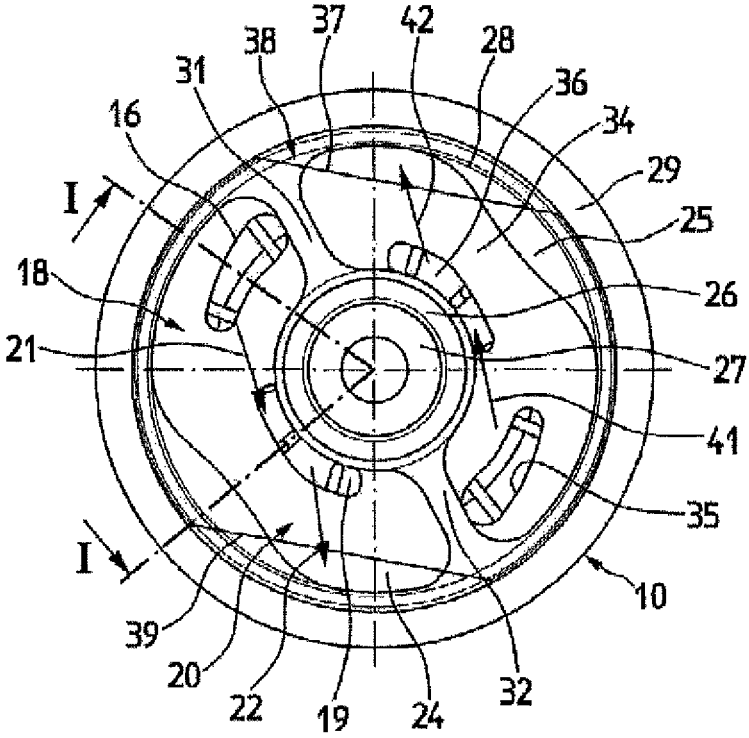
FIG. 2 is a cross-sectional view of the vane-type pump of FIG. 1, shown without the housing.

FIGS. 1 and 2 are different views showing a vane-type pump 1 in greatly simplified representation. Pump 1 includes a housing 2 (shown only in FIG. 1) having a contour ring 4 within which a rotor 5 having vanes 6 is rotationally driven. Preferably, vanes 6 are carried in rotor 5 such that they are able to slide radially. Contour ring 4 or displacement ring 4 has a displacement contour which is configured such that at least one, preferably two substantially crescent-shaped pumping cavities are created. These cavities are traversed by vanes 6. Thus, two pump sections are provided, each including a suction area and a pressure area.

In FIG. 1 at the bottom, rotor 5 and contour ring 4 having the displacement contour rest sealingly against a sealing surface of housing 2. At the opposite side of these two components, there is provided a pressure plate 10, through which the fluid pumped by vane-type pump 1 is pumped from the pressure side of the pump to a pressure outlet 8 connected to a consumer.

According to an essential aspect of the present invention, pressure plate 10, which is shown in a top view in FIG. 2, is divided into three portions or planes 11, 12, 13. In first plane 11, there is formed a pressure passage hole 16 which is in communication with the pressure area within contour ring 4 and which, because of shape, is also referred to as kidney-shaped pressure port. At its end facing away from rotor 5, pressure passage hole 16 opens into a channel section 18 formed in second plane 12 of pressure plate 10. Furthermore, in first plane 11 of pressure plate 10, there is provided an under-vane passage hole 19 which, because of shape, is also referred to as kidney-shaped under-vane port.

At its end facing rotor 5, under-vane passage hole 19 opens into an under-vane supply area provided at the radially inner end of vanes 6. Pressurized working medium, in particular hydraulic oil, is supplied to the under-vane supply area via under-vane passage hole 19 so as to assist in radially extending the vanes. At its end facing away from rotor 5, under-vane passage hole 19 opens into a channel section 20 which, together with channel section 18, bounds a channel or fluid path which is indicated by arrows 21, 22 and extends from pressure passage hole 16 past under-vane passage hole 19 to an opening 24, which is opened by a flow guide device 25 in third plane 13 of pressure plate 10.

Figure 4:
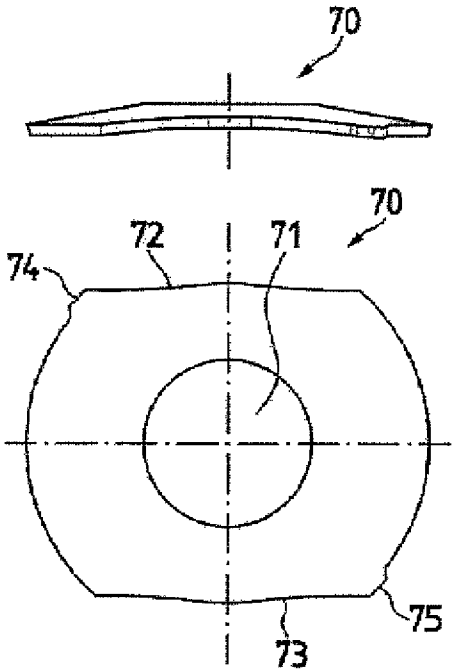

Flow guide device 25 is designed similarly to a flow guide device 70, which is shown in two different views in FIG. 4. Flow guide device 70 takes the form of a diaphragm spring and has a central through hole 71. At its radially outer periphery, diaphragm spring 70 has flattened portions 72, 73 which, when diaphragm spring 70 in the installed position, create an opening which is denoted by 24 in FIG. 2 and which allows pressurized working medium to pass therethrough to pressure outlet 8 of pump 1.

Flow guide device 25 rests with its radially inner edge region on an inner ring member 26 formed in second plane 12 of pressure plate 10. A seal 33 is disposed between the radially inner edge region of flow guide device 25 and pressure plate 10. Inner ring member 26 is connected, via a shoulder, to a further inner ring member 27 extending in third plane 13 of pressure plate 10. Flow guide device 25 rests with its outer edge region on an outer ring member 28 extending in second plane 12 coaxially with inner ring member 26 and further inner ring member 27. Outer ring member 28 is connected, via a further shoulder, to a further outer ring member 29 extending in third plane 13 of pressure plate 10. Flow guide device 25 is disposed in an annular space in third plane 13 of pressure plate 10, said annular space extending between further inner ring member 27 and further outer ring member 29 in third plane 13 of pressure plate 10. Near its radially inner edge region, flow guide device 25 is biased by an annular bulge-like contact portion 30 formed on housing 2.

The two channel sections 18 and 20 together form a channel which is separated from a further channel 34 by lands 31, 32. Lands 31, 32 extend radially from inner ring member 26 to outer ring member 28 in the second plane of pressure plate 10. Lands 31, 32 connect inner ring member 26 integrally to outer ring member 28. Channel 34 connects a further under-vane passage hole 36 to a further pressure passage hole 35. A flattened portion 37 formed on flow guide device 25 creates a further opening 38 to pressure outlet 8 of pump 1. In FIG. 2, arrows 41, 42 indicate a further fluid path via which pressurized working medium can flow from further pressure passage hole 35 past further under-vane passage hole 36 to further opening 38.

The flow guide device 25 of the present invention optimizes the oil flow path from pressure passage holes 16; 35 past under-vane passage holes 19, 36 to pressure outlet 8 of pump 1. This allows the cold-start performance of pump 1 to be significantly improved. The working medium issuing from pressure passage holes 35, 16 is first directed into the under-vane supply area via the associated under-vane passage hole 36, 19, and only subsequently to pressure outlet 8 of pump 1. The associated channels 18, 20 and 34 are bounded by flow guide device 25 on the side of pressure plate 10 facing away from rotor 5. This is helpful especially if a particular housing design does not allow the channel or channels to be bounded within the housing. In the present example, two pump halves are separated by lands 31, 32. In addition, lands 31, 32 may be used to define a desired flow direction. The openings 24, 38 provided by flow guide device 25 are preferably disposed downstream of the respective under-vane passage openings 19, 36.

Figure 5:
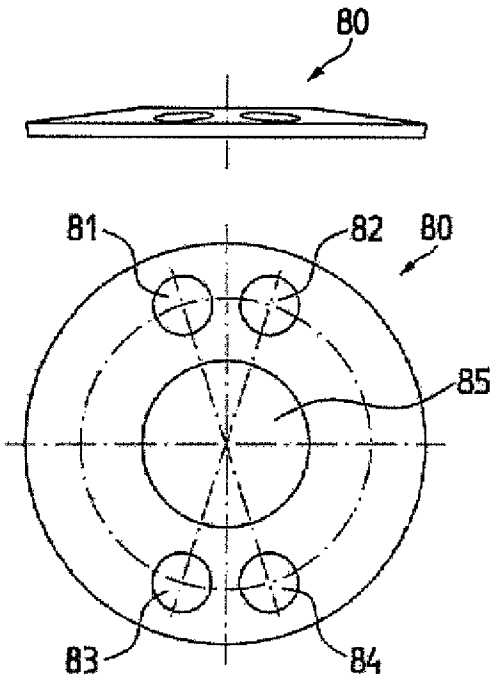
FIGS. 3 through 5 are views of various exemplary embodiments of diaphragm springs, each shown in a top and side view.
Figure 3:
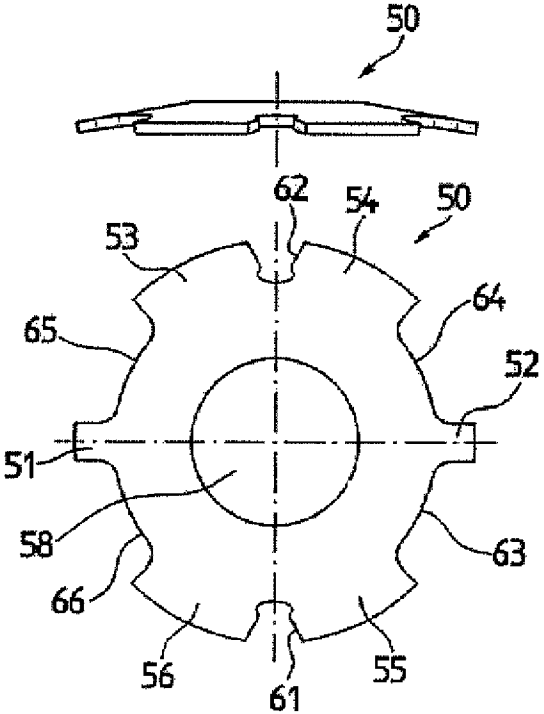

FIGS. 3 through 5 illustrate, in top and side views, different embodiments of flow guide devices in the form of diaphragm springs 50; 70; 80. The diaphragm springs 50; 70; 80 shown may be installed in pump 1 shown in FIGS. 1 and 2 in place of flow guide device 25, which is also in the form of a diaphragm spring.

The diaphragm spring 50 shown in FIG. 3 includes a plurality of substantially radially extending tongues 51 through 56, so that the diaphragm spring is slotted at its outer periphery. A central through hole 58 is formed in the radially inner region of diaphragm spring 50. Tongues 53, 54 and 55, 56 delimit recesses 63, 64 and 65, 66 in a circumferential direction, said recesses each providing an opening which corresponds to the one which, in FIG. 2, is denoted by 24, 38 and is provided by flattened portions 37, 39 of diaphragm spring

25. Further recesses 62 and 61 between tongues 53, 54 and 55, 56 serve to optimize the deformation of the diaphragm spring and allow uniform stress distribution.

Diaphragm spring 70, which is illustrated in FIG. 4 and has been described hereinbefore, has a nose 74, 75 formed in the region of its flattened portions 72, 73, respectively. The two noses 74, 75 are disposed in opposite directions so as to permit non-rotatable mounting of diaphragm spring 70. Non-rotatable mounting has the advantage that flattened portions 72, 73 are correctly positioned during assembly and retained in their correct positions.

The preferential direction of flow in channels 18, 20 and 34 is preferably in the same direction as the rotation of rotor 5. In order to enhance the flow towards under-vane passage holes 19; 36, channels 18, 20 and 34 may be fluid-dynamically optimized, for example, by configuring them to narrow toward under-vane passage holes 19; 36. Channels 18, 20 and 34 may be configured to connect the kidney-shaped pressure port and the kidney-shaped under-vane port of either the same or opposite halves of the pump. The configuration and position of diaphragm springs 25; 50; 70; 80 are preferably selected such that channels 18, 20 and 34 allow the same cross-sectional passage area to be obtained upstream and downstream of the diaphragm spring. In third plane 13, the medium flows from openings 24, 38 to pressure outlet 8.

The diaphragm spring shown in FIG. 5 has the shape of an annular disk having a central through hole 85. In the region of the pressure outlet (denoted by 8 in FIG. 1), two passage holes 81, 82 and 83, 84 are respectively formed to allow pressurized working medium to pass therethrough from the respective channel 18, 20 and 34 to the pressure outlet.

LIST OF REFERENCE NUMERALS

1 pump
2 housing
4 contour ring
5 rotor
6 vane
8 pressure outlet
10 pressure plate
11 first plane
12 second plane
13 third plane
16 pressure passage hole
18 channel section
19 under-vane passage hole
20 channel section
21 arrow
22 arrow
24 opening
25 flow guide device
26 inner ring member
27 further inner ring member
28 outer ring member
29 further outer ring member
30 contact portion
31 land
32 land
33 seal
34 channel
35 pressure passage hole
36 under-vane passage hole
37 flattened portion
38 opening
39 flattened portion
41 arrow
42 arrow
50 diaphragm spring
51 tongue
52 tongue
53 tongue
54 tongue
55 tongue
56 tongue
58 central through hole
61 recess
62 recess
63 recess
64 recess
65 recess
66 recess
70 diaphragm spring
71 central through hole
72 flattened portion
73 flattened portion
74 nose
75 nose
80 diaphragm spring
81 passage hole
82 passage hole
83 passage hole
84 passage hole
85 central through hole

What is claimed is:

1. A pump comprising a rotor carrying at least one vane and resting against at least one pressure plate, the at least one pressure plate having at least one pressure passage hole and at least one under-vane passage hole, the at least one pressure passage hole and the at least one under-vane passage hole communicating with a pressure outlet provided in a housing of the pump, wherein a flow guide device is disposed between the at least one pressure plate and the housing within the at least one pressure plate, the flow guide device bounding a fluid path from the at least one pressure passage hole past the at least one under-vane passage hole to the pressure outlet.

2. The pump as recited in claim 1 wherein the at least one pressure plate includes a first plane containing the pressure passage hole and the under-vane passage hole, and a second plane containing at least one flow channel, the at least one flow channel partially bounding the fluid path from the pressure passage hole past the under-vane passage hole to the pressure outlet.

3. The pump as recited in claim 2 wherein the at least one flow channel in the second plane of the pressure plate is bounded by the flow guide device in an axial direction toward the housing.

4. The pump as recited in claim 2 wherein the at least one pressure plate includes lands, the lands extending in the second plane and separating two flow channels.

5. The pump as recited in claim 2 wherein the at least one pressure plate includes a radially inner ring member extending in the second plane and engaged by a portion of the flow guide device.

6. The pump as recited in claim 5 wherein the at least one pressure plate includes a further radially inner ring member extending in a third plane, encircling the flow guide device and engaged by a seal.

7. The pump as recited in claim 2 wherein the at least one pressure plate includes a radially outer ring member extending in the second plane and engaged by a portion of the flow guide device.

8. The pump as recited in claim 7 wherein the at least one pressure plate includes a further radially outer ring member extending in the third plane and encircling the flow guide device.

9. The pump as recited in claim 2 wherein the at least one flow channel has a constriction in a region of an under-vane groove or kidney-shaped under-vane port.

10. The pump as recited in claim 1 wherein the housing is formed with a contact portion which engages the flow guide device.

11. The pump as recited in claim 1 wherein the flow guide device is a diaphragm spring clamped between the at least one pressure plate and the housing.

12. The pump as recited in claim 11 wherein the diaphragm spring is slotted at a radially outer periphery of the spring.

13. The pump as recited in claim 11 wherein the diaphragm spring is flattened at a radially outer periphery of the spring.

14. The pump as recited in claim 11 wherein the diaphragm spring has at least one passage hole.

15. The pump as recited in claim 1 wherein the pump is a vane-pump.

16. A pump comprising a rotor carrying at least one vane and resting against at least one pressure plate, the at least one pressure plate having at least one pressure passage hole and at least one under-vane passage hole, the at least one pressure passage hole and the at least one under-vane passage hole communicating with a pressure outlet provided in a housing of the pump, wherein a flow guide device is disposed between the at least one pressure plate and the housing, the flow guide device bounding a fluid path from the at least one pressure passage hole past the at least one under-vane passage hole to the pressure outlet, wherein the flow guide device is a diaphragm spring clamped between the at least one pressure plate and the housing, wherein the diaphragm spring is slotted at a radially outer periphery of the spring.

17. A pump comprising a rotor carrying at least one vane and resting against at least one pressure plate, the at least one pressure plate having at least one pressure passage hole and at least one under-vane passage hole, the at least one pressure passage hole and the at least one under-vane passage hole communicating with a pressure outlet provided in a housing of the pump, wherein a flow guide device is disposed between the at least one pressure plate and the housing, the flow guide device bounding a fluid path from the at least one pressure passage hole past the at least one under-vane passage hole to the pressure outlet, wherein the flow guide device is a diaphragm spring clamped between the at least one pressure plate and the housing, wherein the diaphragm spring is flattened at the radially outer periphery of the spring.

18. A pump comprising a rotor carrying at least one vane and resting against at least one pressure plate, the at least one pressure plate having at least one pressure passage hole and at least one under-vane passage hole, the at least one pressure passage hole and the at least one under-vane passage hole communicating with a pressure outlet provided in a housing of the pump, wherein a flow guide device is disposed between the at least one pressure plate and the housing, the flow guide device bounding a fluid path from the at least one pressure passage hole past the at least one under-vane passage hole to the pressure outlet, wherein the flow guide device is a diaphragm spring clamped between the at least one pressure plate and the housing, wherein the diaphragm spring has at least one passage hole.

* * * * *